US009351576B1

(12) United States Patent
Rogers et al.

(10) Patent No.: US 9,351,576 B1
(45) Date of Patent: May 31, 2016

(54) OTTOMAN LINKAGE MECHANISM WITH CLOSING ASSIST

(71) Applicant: L&P PROPPERTY MANAGEMENT COMPANY, South Gate, CA (US)

(72) Inventors: W. Clark Rogers, New London, NC (US); Jason Allan Bryant, Fulton, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/639,533

(22) Filed: Mar. 5, 2015

(51) Int. Cl.
*A47C 1/034* (2006.01)
*A47C 1/0355* (2013.01)

(52) U.S. Cl.
CPC ..... *A47C 1/0345* (2013.01); *A47C 1/0355* (2013.01)

(58) Field of Classification Search
CPC .... A47C 1/034; A47C 1/0342; A47C 1/0345; A47C 1/035; A47C 1/0355; A47C 7/50
See application file for complete search history.

(56) References Cited

U.S. PATENT DOCUMENTS 5,246,266 A * 9/1993 Ostergaard ..... A47C 1/035 297/317
5,323,526 A * 6/1994 Saul ..... A47C 1/0345 29/434
5,368,366 A * 11/1994 Mizelle ..... A47C 1/0345 297/423.3
5,704,686 A * 1/1998 May ..... A47C 1/0355 297/273
6,120,095 A * 9/2000 Rogers ..... A47C 1/0352 248/370
7,147,278 B2 * 12/2006 Johnson ..... A47C 1/0352 297/85 R
7,322,650 B2 * 1/2008 Chouinard ..... A47C 1/0345 297/270.2
2009/0033129 A1 * 2/2009 Marshall ..... A47C 1/034 297/69
2012/0112518 A1 * 5/2012 Murphy ..... A47C 1/0355 297/85 L
2013/0200658 A1 * 8/2013 Hoffman ..... A47C 1/0342 297/75
2013/0257110 A1 * 10/2013 Fischer ..... A47C 1/0355 297/83

* cited by examiner

*Primary Examiner* — Philip Gabler
(74) *Attorney, Agent, or Firm* — Shook, Hardy & Bacon, L.L.P.

(57) ABSTRACT

A mechanism is provided that allows an assisting force to be imparted on an ottoman as the ottoman moves from an extended position back to a closed position. The linkage includes a rotatable lock bracket and an ottoman lock link pivotally coupled to the lock bracket. A rear ottoman link is pivotally coupled to an ottoman linkage, and a spring activation link is pivotally coupled to the ottoman lock link. A spring extends between the lock bracket and the first end of the spring activation link, supported by a spring retaining link. A catch finger positioned on the rear ottoman link selectively engages the second end of the spring activation link. The spring activation link operates to extend the spring as the ottoman moves from an extended position to a closed position, thereby providing an assisting force in moving the mechanism to the closed position.

15 Claims, 15 Drawing Sheets

OTTOMAN LINKAGE MECHANISM WITH CLOSING ASSIST

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the disclosure relates to an improved ottoman linkage mechanism that is configured to assist the user in closing the ottoman linkage.

Reclining seating units exist that allow a user to extend a footrest forward and to recline a backrest rearward relative to a seat. These existing seating units typically provide three basic positions (e.g., a standard, non-reclined closed position; an extended position; and a reclined position). In the closed position, the seat resides in a generally horizontal orientation and the backrest is disposed substantially upright. Additionally, the seating unit includes one or more ottomans attached with a mechanical arrangement, the mechanical arrangement is collapsed such that one or more ottomans are not extended. In the extended position, often referred to as a television ("TV") position, the one or more ottomans are extended forward of the seat, and the backrest remains sufficiently upright to permit comfortable television viewing by an occupant of the seating unit. In the reclined position, the backrest is pivoted rearward from the extended position into an obtuse relationship with the seat for lounging or sleeping.

In non-motorized versions of modern seating units, the user manually adjusts the seating unit from the closed position to the TV position, and back, to extend and retract the ottoman or footrest. It would be helpful to ease the force required to return the ottoman from the TV position to the closed position.

Accordingly, embodiments of the mechanism pertain to an improved recliner mechanism that assists the user in moving the recliner from the TV position, with the ottoman extended, to the closed position, with the ottoman retracted.

BRIEF SUMMARY OF THE INVENTION

Generally, a recliner will have two opposed recliner mechanisms, one on each side. The mechanisms typically have a rail that allows the mechanism to be affixed to the inner side of the chair base. The recliner mechanism also has a back mounting link that couples the chair back to the mechanism and a seat mounting plate that supports a seating surface between the sides of the chair. Finally, the recliner mechanism has an ottoman bracket that supports an ottoman from the chair. A number of links interconnect the back, seat, and ottoman for movement relative to the chair base. In operation, the recliner mechanisms are adapted to move between a closed position, an extended TV position, and a reclined position.

Embodiments seek to provide an improved recliner mechanism that assists the user in closing the ottoman. In an exemplary embodiment, a spring retaining link is coupled to a lock bracket. The spring retaining link is used to support, and act as the anchor point for, one end of an extension spring. The other end of the extension spring is coupled to a spring activation link, which is rotatably coupled to the ottoman lock link. A catch finger is used to selectively couple the spring activation link to the motion of a rear ottoman link. As the rear ottoman link rotates about a pivotal coupling to a seat mounting plate, the spring activation link moves with respect to the spring retaining link. When the mechanism moves from the TV position to the closed position, the relative movement of the spring activation link and the spring retaining link causes the extension spring to extend for the first part of the closing movement, and to retract during the second part of the closing movement. The retraction of the extension spring provides assistance in closing the ottoman. The overall effect of which is to enable the recliner mechanism to be returned to the closed position from the TV position with less force, making it easier for the user to return the recliner to the closed position.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
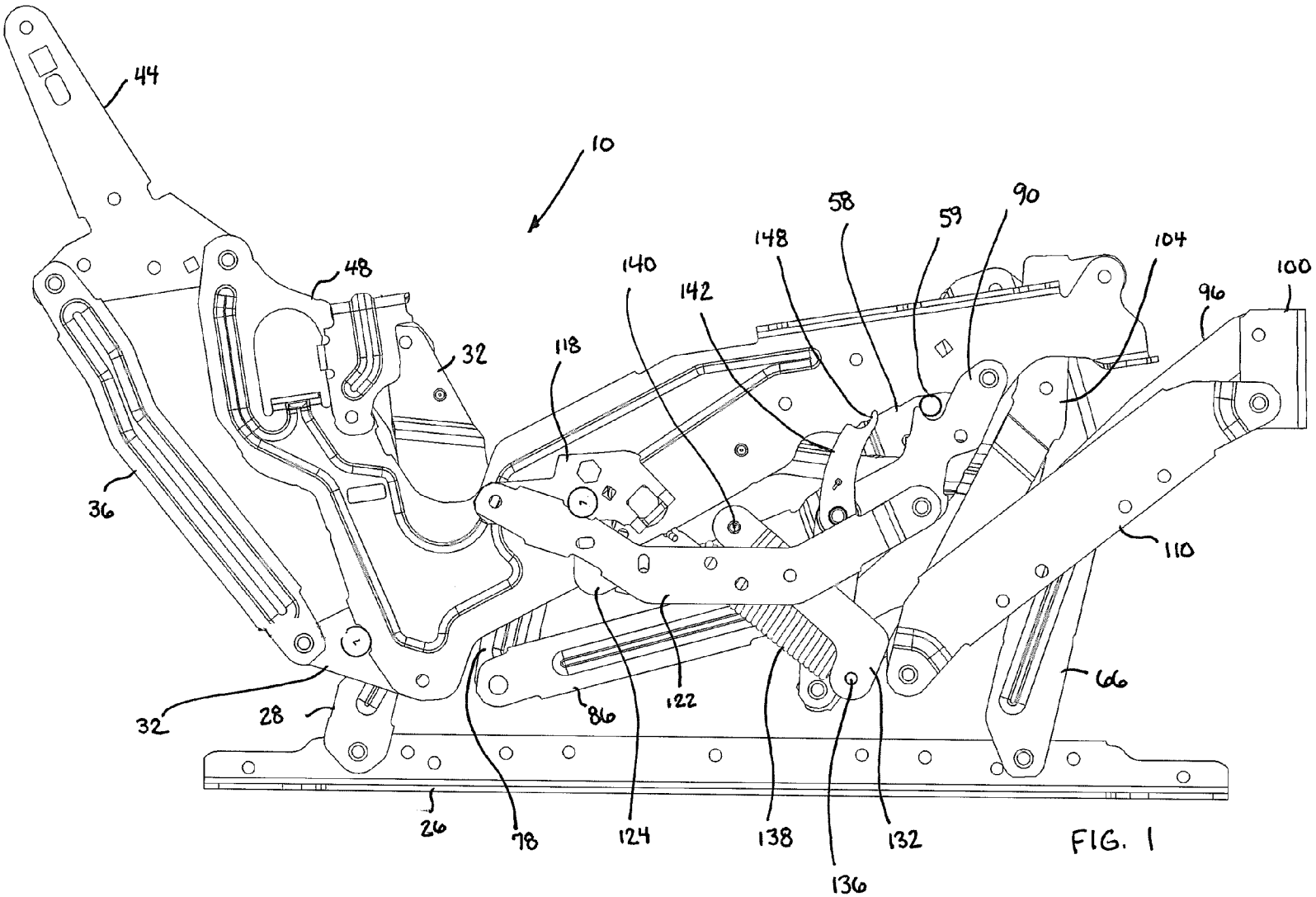
FIG. 1 is a side view of a mechanism for a seating unit in a closed position, shown from the outside.
Figure 2:
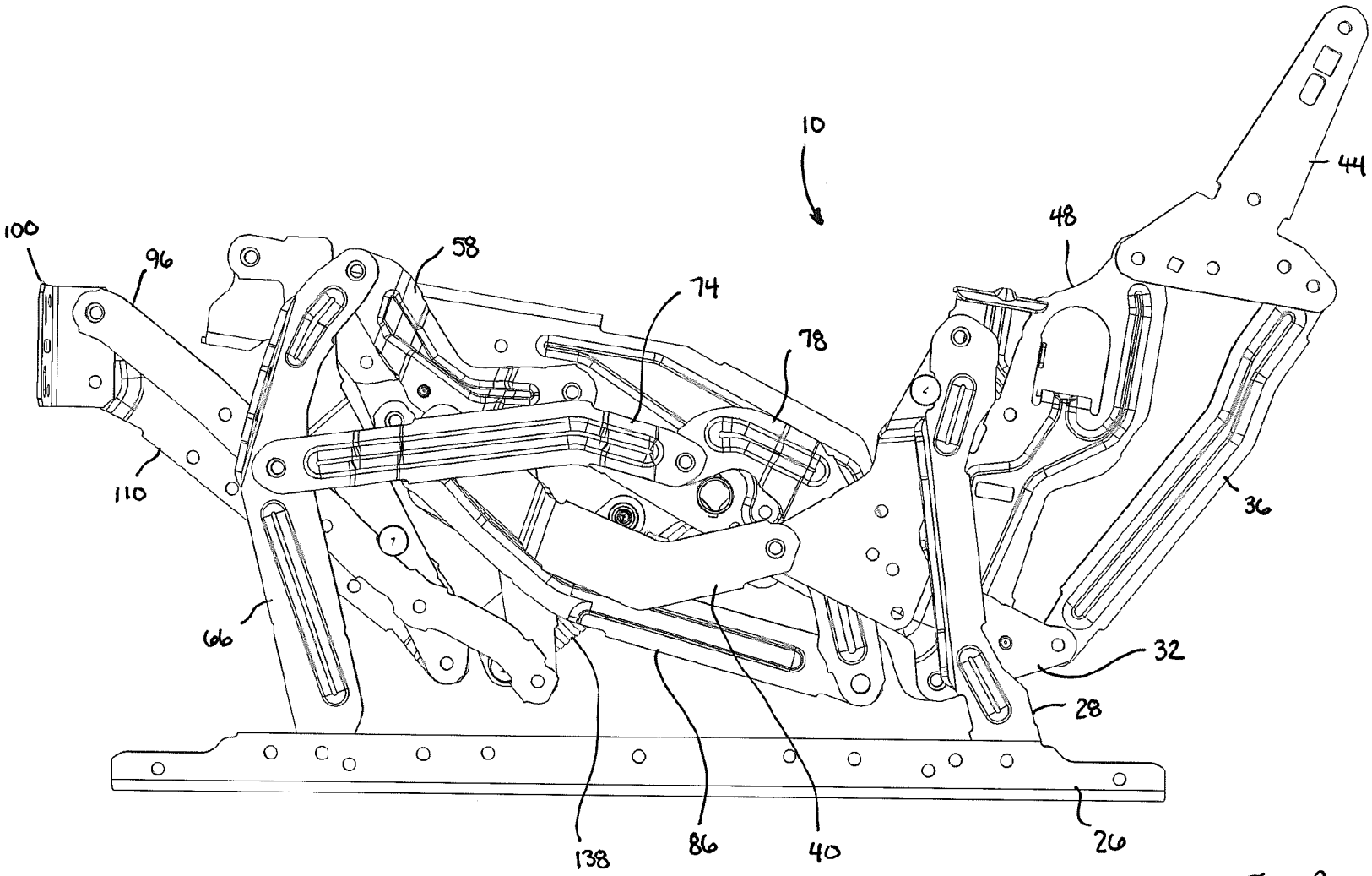
FIG. 2 is a side view of the mechanism of FIG. 1, shown from the inside.

FIGS. 1-15 illustrate a mechanism 10 for use on a motion seating unit. As described below, the linkage mechanism 10 comprises a plurality of other linkages that are arranged to actuate and control movement of the seating unit during movement between the closed, extended, and reclined positions. These linkages may be pivotally interconnected. The pivotal couplings (illustrated as pivot points in the figures) between these linkages can take a variety of configurations, such as pivot pins, bearings, traditional mounting hardware, rivets, bolt and nut combinations, or any other suitable fasteners, which are well known in the furniture-manufacturing industry. Further, the shapes of the linkages and the brackets may vary, as may the locations of certain pivot points. It will be understood that when a linkage is referred to as being pivotally "coupled" to, "interconnected" with, "attached" on, etc., another element (e.g., link, bracket, rail, and the like), it is contemplated that the linkage and elements may be in direct contact with each other or other elements, such as intervening elements, which may also be present. Not all reference numerals are listed on all figures, for clarity, but the same parts numbered in one figure correspond to similar parts numbered in other figures.

Generally, the linkage mechanism 10 guides the movement of a backrest, seat, and ottoman of the recliner on which it is installed. In an exemplary configuration, these movements are controlled by a pair of essentially mirror-image linkage mechanisms (one of which is shown herein and indicated by reference numeral 10), which comprise an arrangement of pivotal interconnected linkages. The linkage mechanisms are disposed in opposing-facing relation about a longitudinally extending plane that bisects the recliner between a pair of opposed sides. As such, the ensuing discussion will focus on only one of the linkage mechanisms 10, with the content being equally applied to the other complimentary linkage assembly. The mechanism 10 couples the seat, the backrest, and the ottoman together to move the seating unit between closed, TV, and fully reclined positions, as is more fully described below.

Figure 8:
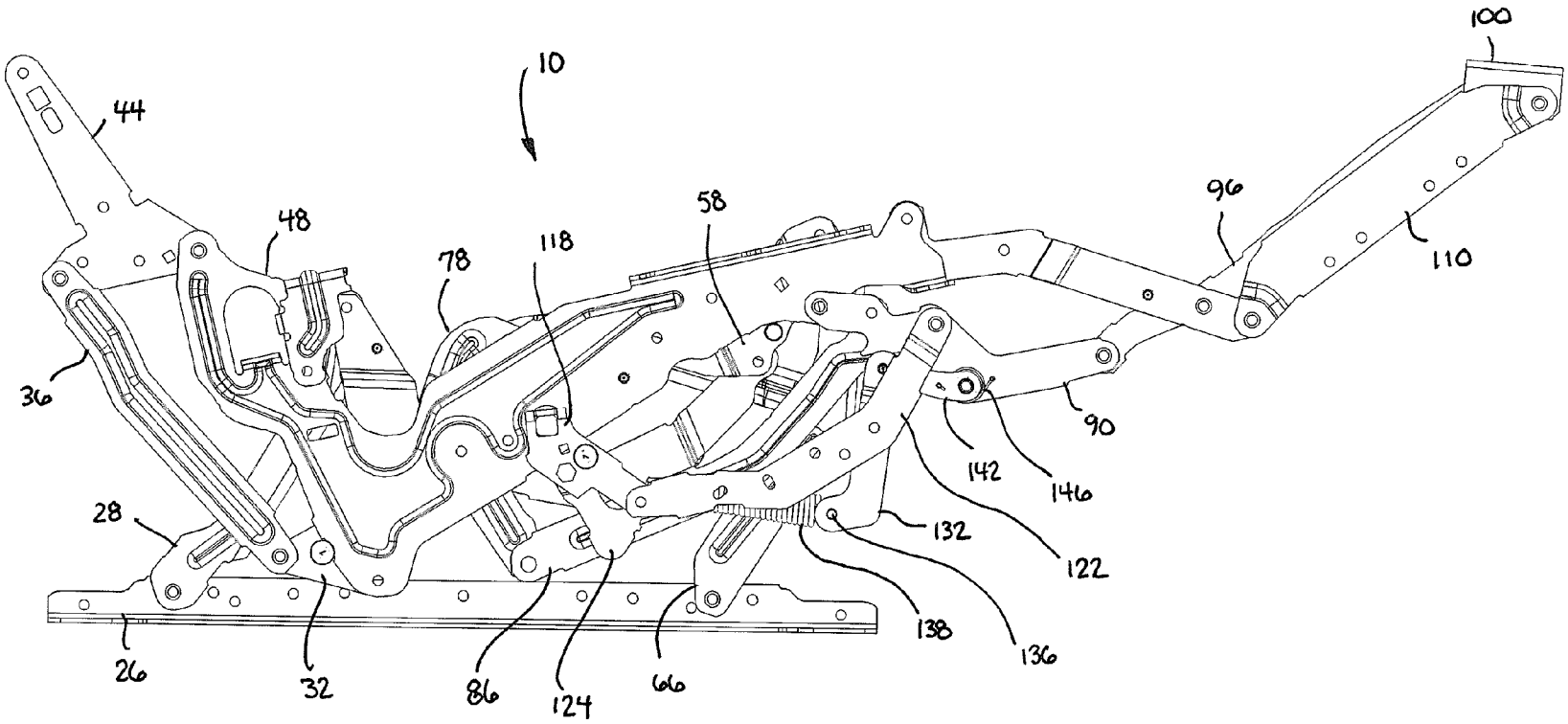
FIG. 8 is a side view of a mechanism for a seating unit in a TV position, shown from the outside.
Figure 9:
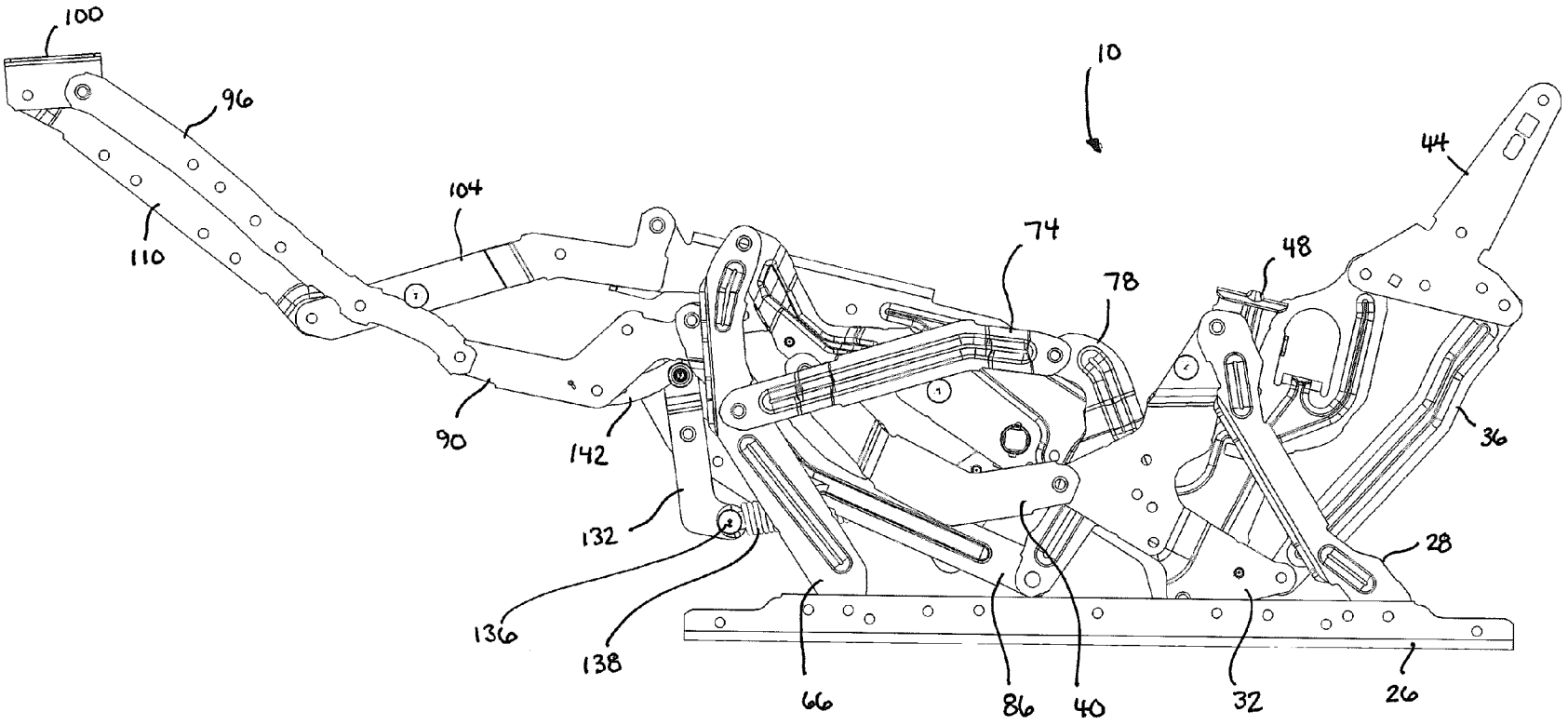
FIG. 9 is a side view similar to FIG. 8, from the inside.
Figure 10:
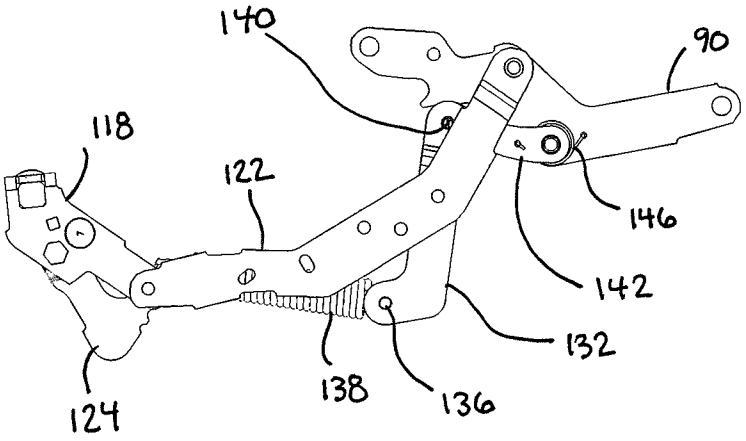
FIG. 10 is an enlarged side view of selected parts of FIG. 8, with other parts removed for clarity.
Figure 11:
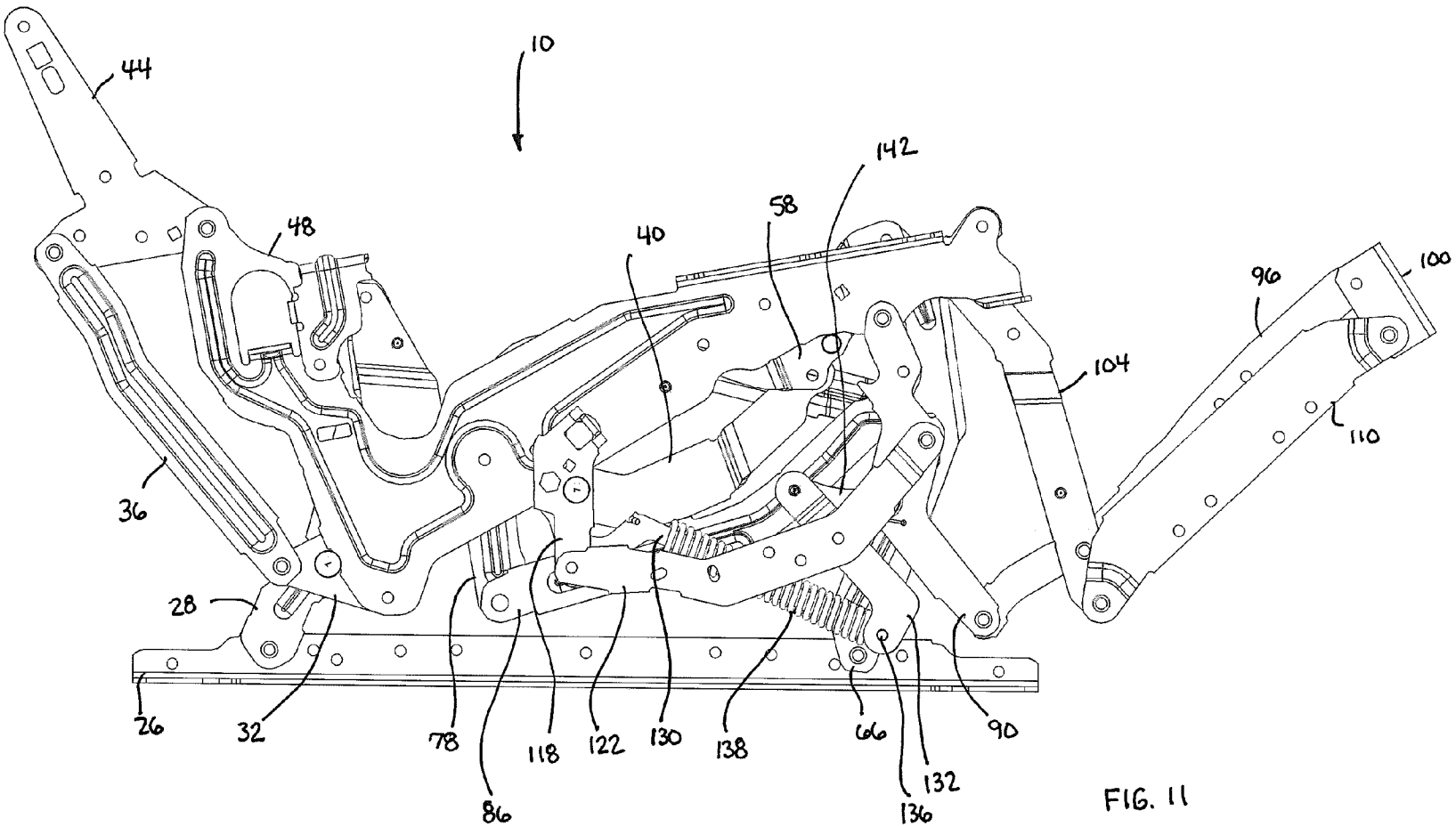
FIG. 11 is a side view of a mechanism for a seating unit in a partially closed position, shown from the outside.
Figure 12:
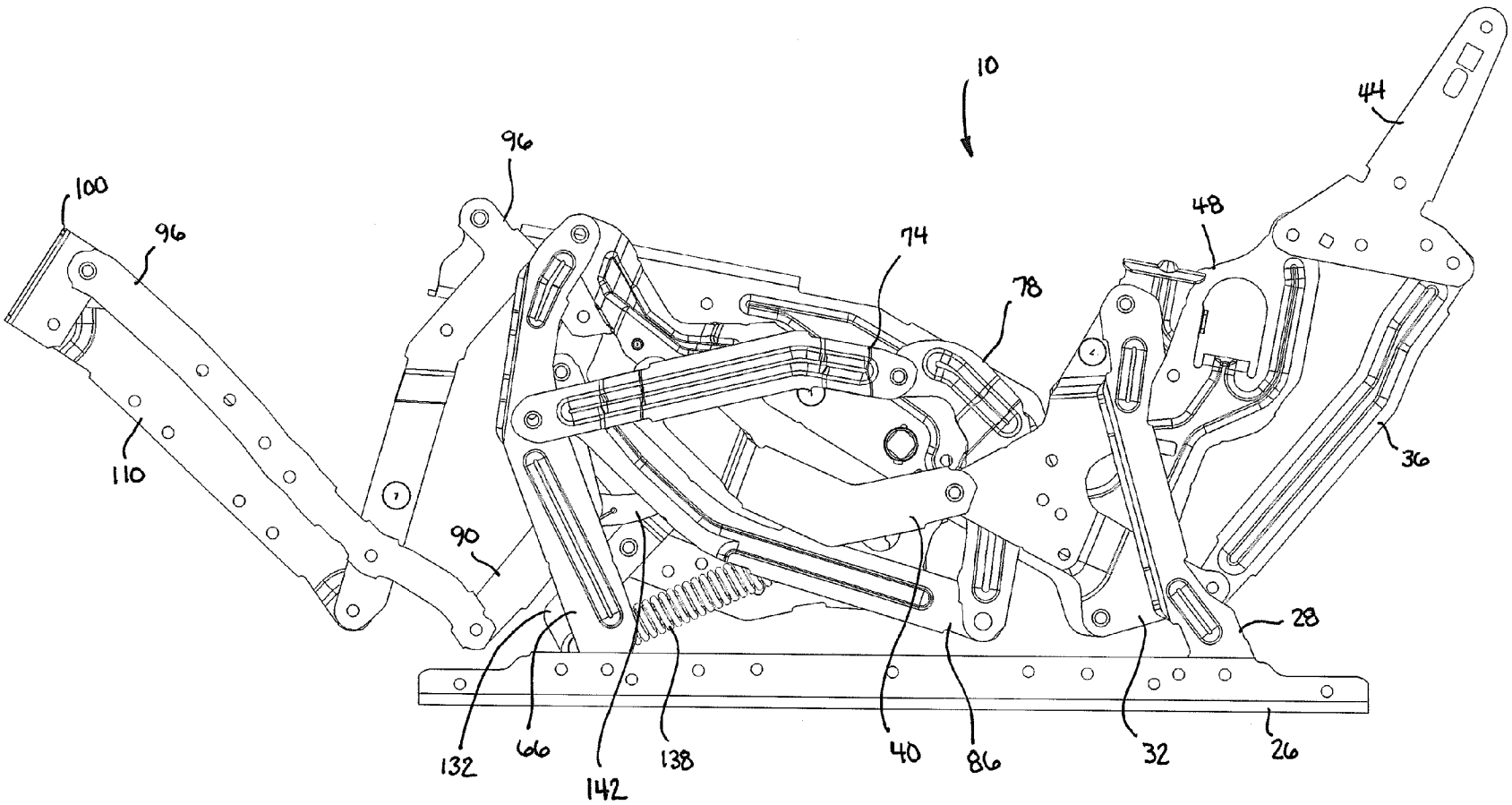
FIG. 12 is a side view similar to FIG. 11, from the inside.
Figure 13:
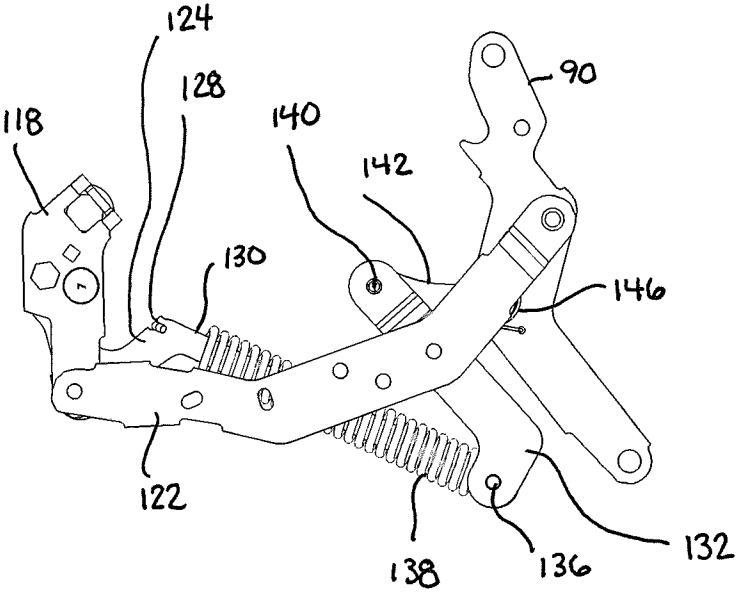
FIG. 13 is an enlarged side view of selected parts of FIG. 11, with other parts removed for clarity.

The mechanism 10 is adjustable to three basic positions: a closed position (FIG. 1), an extended position (i.e., TV position)(FIG. 8), and a reclined position (not shown). FIG. 1 depicts the mechanism 10 adjusted to the closed position, which is a normal non-reclined sitting position with the seat in a generally horizontal position and the backrest generally upright and in a substantially perpendicular biased relation to the seat. Note that FIGS. 1-15 show the mechanism 10, with the outer parts of the seating unit removed for clarity. In addition, when adjusted to the closed position, the ottoman is positioned below the seat. FIG. 8 depicts the extended, or TV, position. When the seating unit is adjusted to the extended position, the ottoman is extended forward so it is generally horizontal. However, the backrest remains substantially perpendicular to the seat.

FIGS. 1-15 illustrate details of the configuration of linkage mechanism 10. Mechanism 10 has a pair of parallel, spaced sides, one left and one right, although only one side is shown in the figures for clarity. Each side of mechanism 10 includes a side rail 26 that extends from the front of the seating unit to the back. Rails 26 are used to mount the mechanism 10 to the base of the seating unit and operate as the base of the mechanism 10. A rear pivot link 28 extends upwardly from the rail 26 and is pivotally connected to the rail 26 at a lower end thereof. Unless otherwise described differently, each of the rails, links, and brackets described herein are typically made of formed or stamped steel, but other materials with similar characteristics could be used. The upper end of rear pivot link 28 is pivotally coupled to a rear bell crank 32. Rear bell crank 32 is also pivotally coupled to a rear control link 36. Finally, rear bell crank 32 is pivotally coupled to a bridge link 40. As can be seen, rear bell crank 32 is somewhat triangularly shaped and connects the rear pivot link 28, the rear control link 36, and the bridge link 40.

The rear control link 36 is coupled on one end to the rear bell crank 32. It extends upwardly and rearwardly, and is pivotally connected to a back mounting link 44 at its other end. Rear control link 36 is thus pivotally connected between rear bell crank 32 and back mounting link 44. Back mounting link 44 has a forward end that is pivotally coupled to a seat mounting plate 48. The upper end of back mounting link 44 is used to couple the backrest of the seating unit to the mechanism 10. As back mounting link 44 pivots rearwardly, the backrest is reclined.

Returning to bridge link 40, it can be seen that one end of bridge link 40 is pivotally coupled to rear bell crank 32. The opposite, forward end of bridge link 40 is pivotally coupled to an L-shaped, front lift link 58. The outer end of one leg of front lift link 58 is pivotally coupled to seat mounting plate 48. The outer end of the other leg of front lift link 58 is pivotally coupled to a front pivot link 66. Front lift link 58 is thus pivotally connected to bridge link 40, seat mounting plate 48, and front pivot link 66. As seen in FIG. 1, front lift link 58 has a stop pin 59 rigidly secured thereto and extending therefrom.

Front pivot link 66 is thus coupled on one end to the front lift link 58 and is pivotally coupled on the opposite, lower end to side rail 26. A carrier link 74 is pivotally coupled to front pivot link 66 generally mid-way along the link. Carrier link 74 extends rearwardly and is coupled on its other end to a front bell crank 78.

Front bell crank 78 has a somewhat boomerang shape, as shown. One end of front bell crank 78 is pivotally coupled to carrier link 74. Generally, at the mid-point, front bell crank 78 is pivotally coupled to seat mounting plate 48. The opposite end of front bell crank 78 is pivotally coupled to ottoman drive link 86. As best seen in FIG. 8, the other end of ottoman drive link 86 is pivotally coupled to rear ottoman link 90. Rear ottoman link 90 is pivotally coupled at its top end to seat mounting plate 48. The lower end of rear ottoman link 90 is pivotally coupled to a top ottoman link 96. Rear ottoman link 90 has a notch to accommodate stop pin 59 when the linkage is in a closed position. The top ottoman link 96 is part of the ottoman linkage and is pivotally coupled at its opposite end to an ottoman bracket 100. Ottoman bracket 100 is connected to and supports the ottoman of the seating unit. Top ottoman link 96 is pivotally coupled to a front ottoman link 104. One end of front ottoman link 104 is pivotally coupled to seat mounting plate 48. The other end of front ottoman link 104 is pivotally coupled to a lower ottoman link 110. Opposite that pivot, lower ottoman link 110 is pivotally coupled to ottoman bracket 100.

Figure 4:
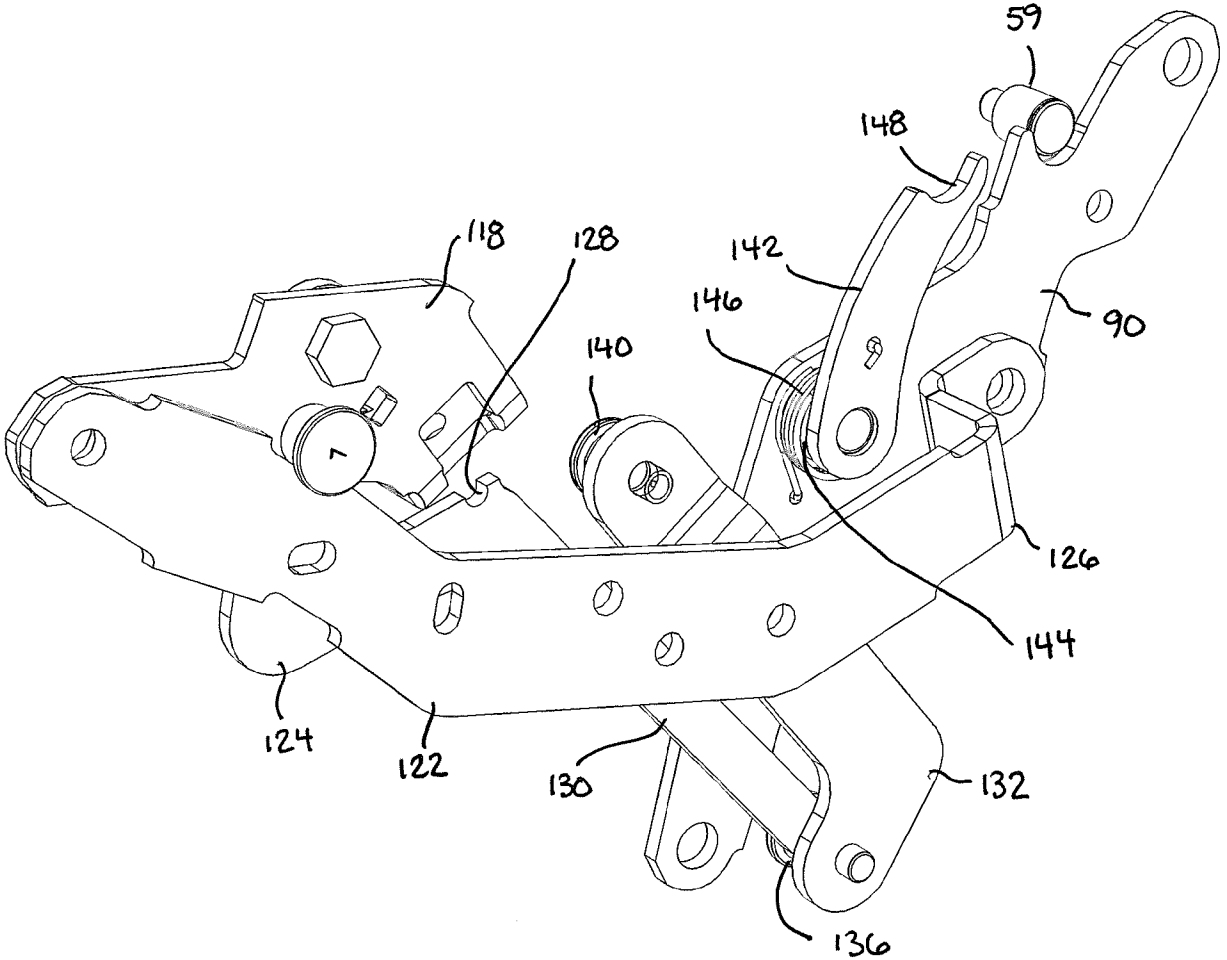
FIG. 4 is a view similar to FIG. 3, but shown with a spring removed.
Figure 5:
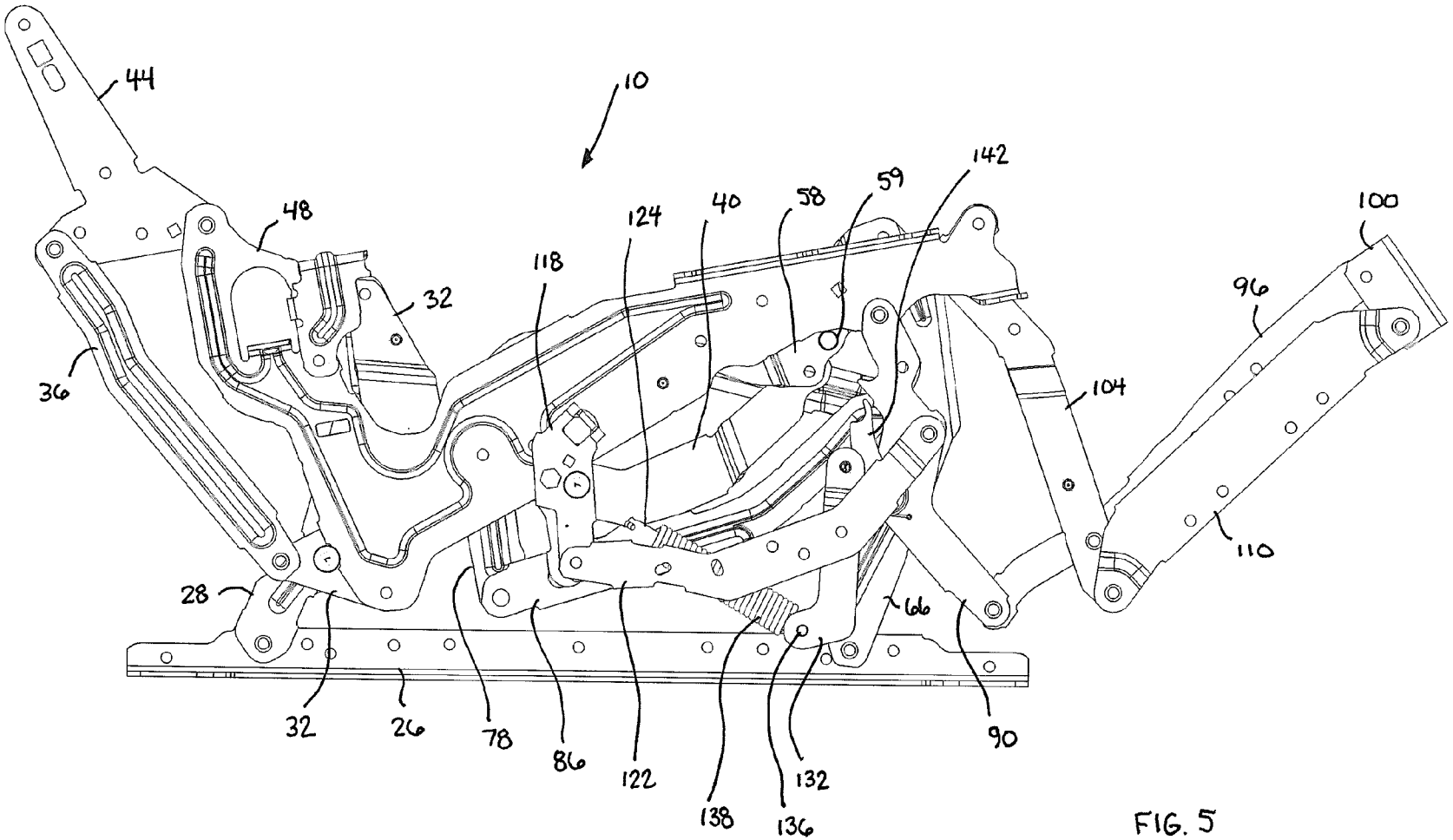
FIG. 5 is a side view of the mechanism of FIG. 1, shown from the outside, shown in a partially open position.
Figure 6:
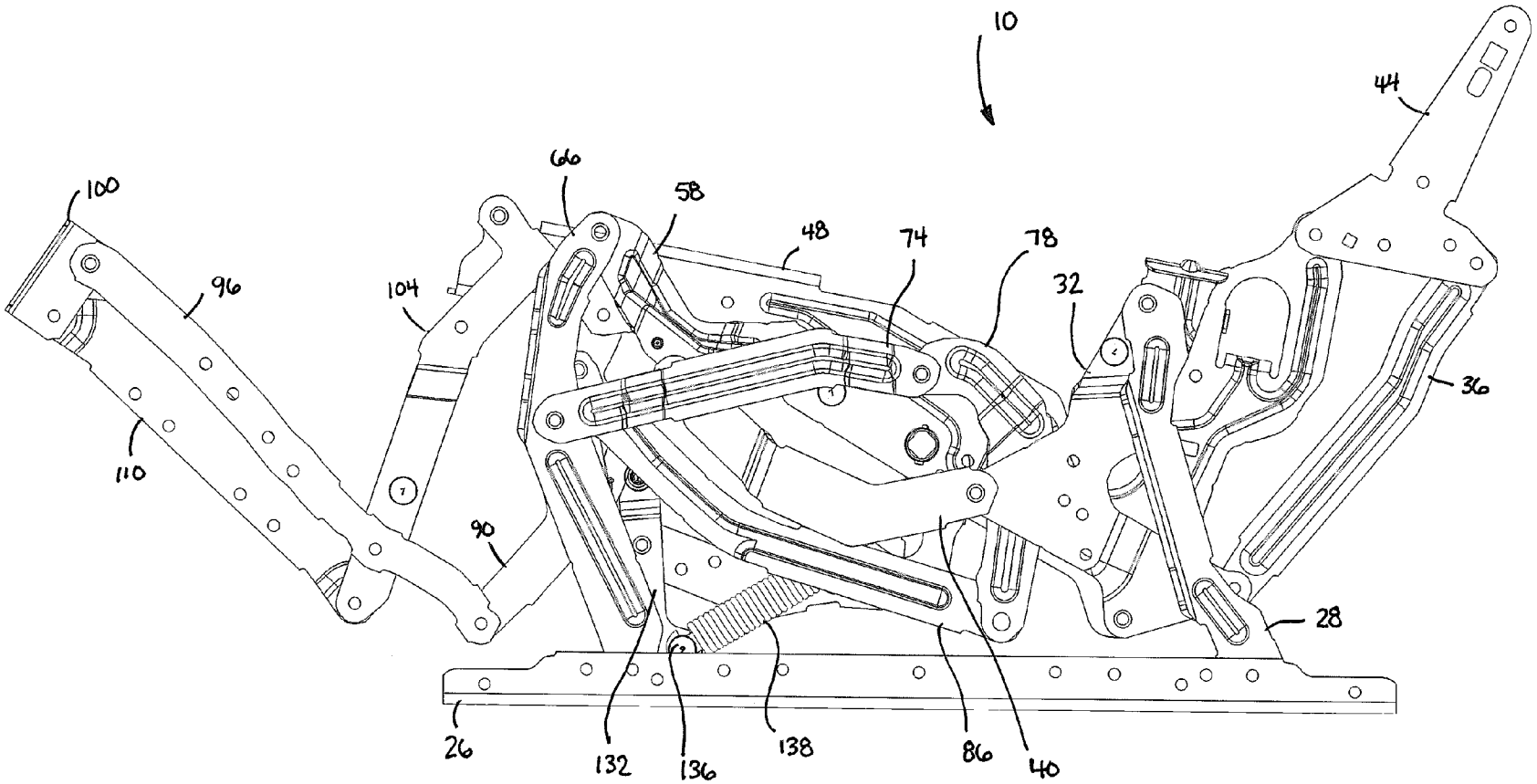
FIG. 6 is a side view similar to FIG. 5, from the inside.
Figure 7:
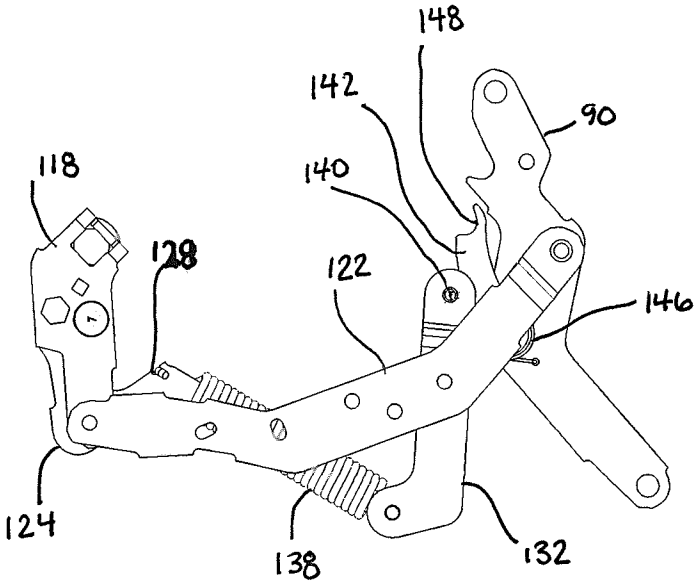
FIG. 7 is an enlarged side view of selected parts of FIG. 5, with other parts removed for clarity.
Figure 14:
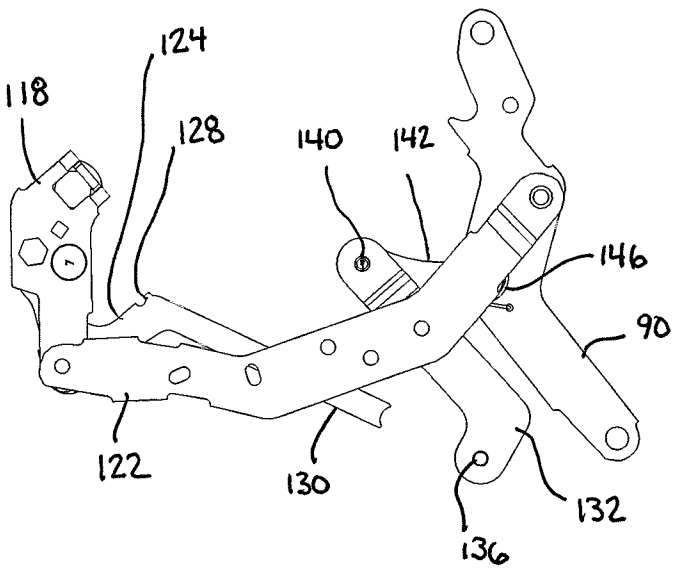
FIG. 14 is a side view similar to FIG. 13, but shown with a spring removed.
Figure 15:
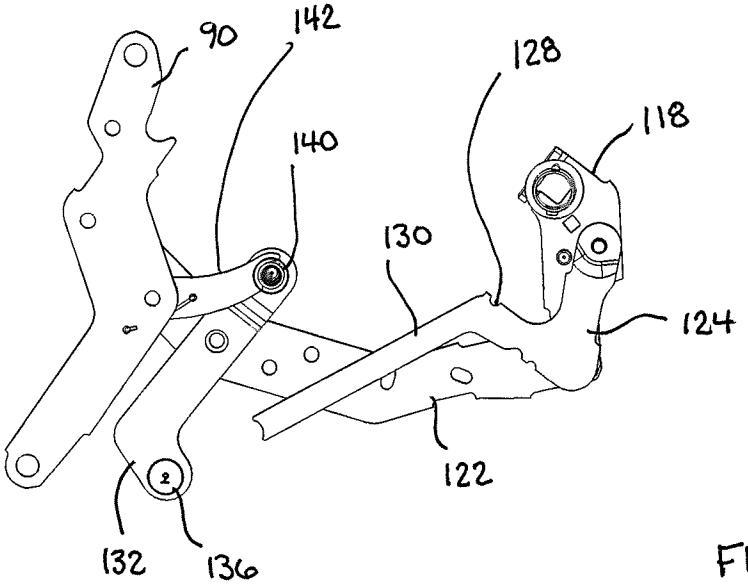
FIG. 15 is a side view similar to FIG. 14, from the inside.

Returning to seat mounting plate 48, a lock bracket 118 is secured to a drive tube generally around the midpoint of seat mounting plate 48. Lock bracket 118 is used to secure a drive tube between both seat mounting plates 48 and to couple an actuation mechanism (not shown) to the mechanism 10. Operation of the actuation mechanism rotates bracket 118 and allows movement of the mechanism between the closed, TV, and reclined positions. The outer end of lock bracket 118 is pivotally coupled to an ottoman lock link 122. The ottoman lock link 122 extends from bracket 118 to the rear ottoman link 90, and is pivotally coupled thereto. A spring retaining link 124 is also pivotally coupled to bracket 118. Near the top of the bend section, spring retaining link 124 has a notch 128, as seen in FIG. 4. Extending away from the bend section, spring retaining link 124 has an elongated arm 130 (as best seen in FIGS. 14 and 15) that terminates in a curved end. A spring activation link 132 is pivotally coupled to ottoman lock link 122. The lower end of spring activation link 132 has a pin 136 that extends away from link 132. An extension spring 138 is coupled between spring retaining link 124 and spring activation link 132. More specifically, one end of spring 138 is coupled to spring retaining link 124 at the notch 128, although other attachment systems could be used to couple spring 138 and spring retaining link 124. The spring 138 generally surrounds arm 130 of spring retaining link 124. The other end of spring 138 is coupled to the pin 136 of spring activation link 132. In the closed and TV positions, the curved end of arm 130 generally abuts pin 136. The end of spring activation link 132 opposite pin 136 has a pin 140 coupled thereto, and extending therefrom. The function of pin 140 is discussed more fully below.

Figure 3:
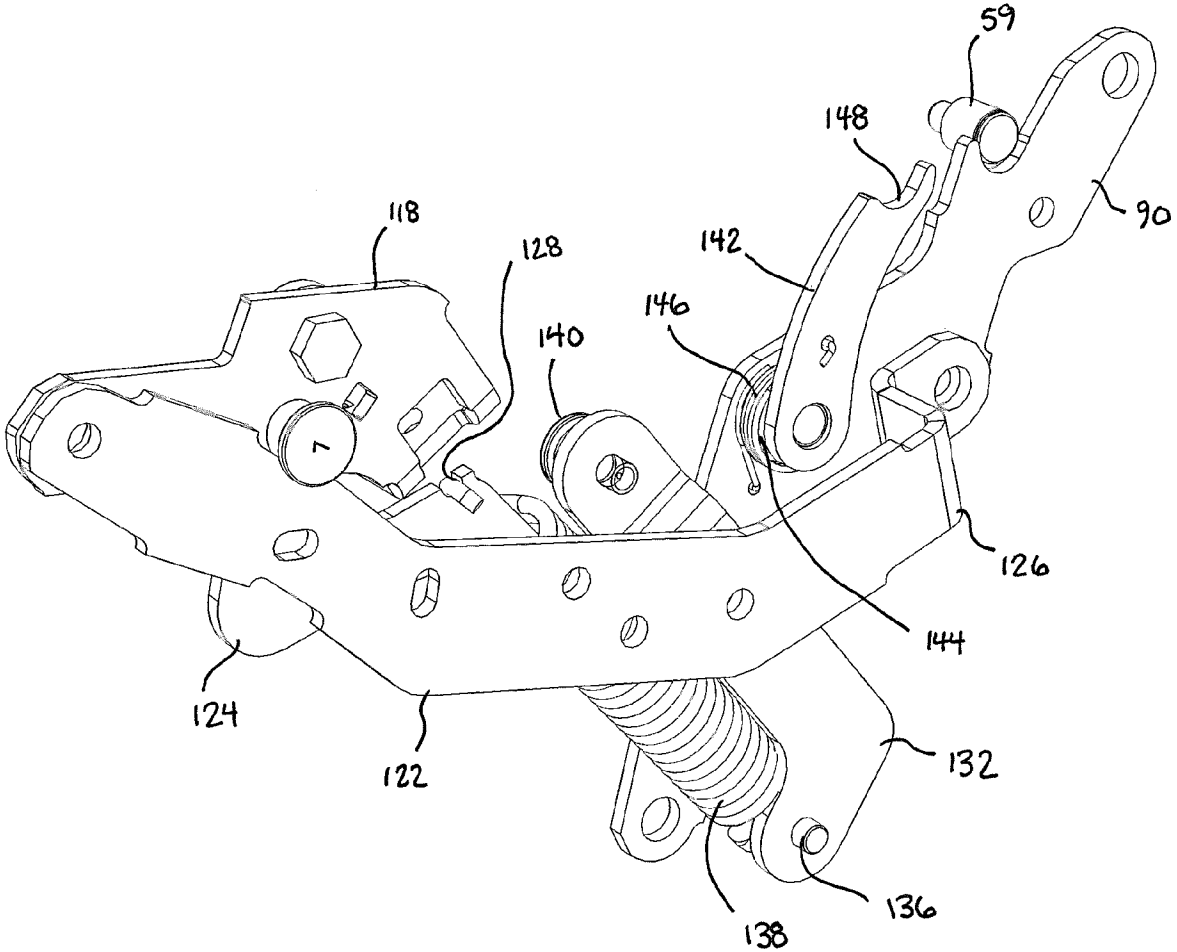
FIG. 3 is an enlarged perspective view of selected parts of FIG. 1, with other parts removed for clarity.

As best seen in FIG. 3, rear ottoman link 90 has a catch finger 142 pivotally coupled thereto. The catch finger 142 is spaced away from the rear ottoman link 90 by a bushing 144. A torsion spring 146, with one end coupled to rear ottoman link 90 and one end coupled to catch finger 142, generally surrounds, and is supported by, bushing 144. As viewed in FIG. 3, torsion spring 146 places a clockwise movement on finger 142 about bushing 144. The end of catch finger 142 opposite bushing 144 has a curved catch surface 148 that is shaped and sized to mate with pin 140 on spring activation link 132. Ottoman lock link 122 has a bend section 126 near the connection to rear ottoman link 90 to provide clearance for catch finger 142 and spring activation link 132.

In operation, starting from the TV position of FIG. 8, the mechanism provides an assisting force to close the ottoman and return the mechanism to the closed position. In operation, a user provides a downward force to the ottoman, such as with the user's legs, or provides a rotational force to the lock bracket 118, such as with a handle connected to bracket 118 (not shown). This force causes rear ottoman link 90 to rotate about the connection to the seat mounting plate 48 (clockwise as viewed in FIG. 8). As the rear ottoman link 90 rotates, it causes catch finger 142 to move downward and rearward, as can be seen by comparing FIG. 10 to FIG. 13. Because the curved catch surface 148 of finger 142 is engaged with pin 140, the downward and rearward movement of catch finger 142 causes spring activation link 132 to rotate about the pivotal connection to ottoman lock link 122 (counterclockwise as viewed in FIG. 10). This rotation moves pin 136 attached to spring activation link 132 away from the curved end of the elongated arm 130 of the spring retaining link 124. At the same time, rotation of the lock bracket 118 causes the spring retaining link 124 to move in the opposite direction, or away from, pin 136. The result is an extension, or loading, of the extension spring 138 as the ottoman begins to close. So, as the ottoman continues to close, the spring 138 will exert a countering force to pin 136, which operates to assist in rotating rear ottoman link 90. The end result of the spring extension is to provide assistance to the user in closing the mechanism, making it feel easier to move the mechanism from the TV to the closed position.

Once in the closed position, the torsion spring 146 imparts a rotational force to catch finger 142, relative to spring activation link 132 and generally about the axis formed by bushing 144. This action "lifts" the catch finger 142 upwardly away from pin 140, effectively disengaging the catch finger 142 from the spring activation link 132. If a user then initiates opening the mechanism from the closed position to the TV position, the initial downward motion of catch finger 142 (caused by rotation of the rear ottoman link being rotated by the lock bracket 118 and the ottoman lock link 122) results in re-engagement of the curved surface 148 of catch finger 142 with the pin 140 on spring activation link 32. Through the addition of a few links, assistance is provided to the user in moving the mechanism from the TV to the closed position.

While not described in detail, those of skill in the art will recognize the mechanism shown and described will operate to also move from the TV position to the fully reclined position.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A mechanism providing an assisting force to an ottoman for a seating unit, as the ottoman moves from an extended position back to a closed position, the mechanism comprising:

a base side rail;

a seat mounting plate spaced apart from the base; and a linkage mechanism that moveably interconnects the base and the seat mounting plate, the linkage mechanism including:

a lock bracket rotatable with respect to the seat mounting plate;

an ottoman lock link having first and second ends, the first end being pivotally coupled to the lock bracket;

a rear ottoman link having first and second ends, the first end being pivotally coupled to the seat mounting plate, and the second end being pivotally coupled to an ottoman linkage, the rear ottoman link also being pivotally coupled to the second end of the ottoman lock link;

a spring activation link pivotally coupled to the ottoman lock link at a location spaced part-way between the first and second ends of the ottoman lock link, the spring activation link having first and second ends;

a spring extending between the lock bracket and the first end of the spring activation link; and a catch finger coupled to the rear ottoman link, the catch finger positioned on the rear ottoman link to engage the second end of the spring activation link;

wherein the spring activation link operates to extend the spring as the ottoman moves from an extended position to a closed position, thereby providing an assisting force in moving the mechanism to the closed position.

2. The mechanism of claim 1, further comprising a spring retaining link pivotally coupled to the lock bracket, a portion of said spring retaining link extending through said spring.

3. The mechanism of claim 2, wherein the spring retaining link has a spring retaining notch to capture the end of the spring opposite the first end of the spring activation link.

4. The mechanism of claim 3, wherein the catch finger is configured to capture a pin on the second end of the spring activation link as the mechanism moves from the closed to the extended position.

5. The mechanism of claim 4, further comprising a torsion spring coupled to the catch finger to bias the catch finger, to release the catch finger from the pin on the second end of the spring activation link when the mechanism moves to the closed position.

6. A mechanism having a linkage providing an assisting force to an ottoman for a seating unit, as the ottoman moves from an extended position back to a closed position, the linkage comprising:

a rotatable lock bracket;

an ottoman lock link having first and second ends, the first end being pivotally coupled to the lock bracket;

a rear ottoman link having first and second ends, the first end being pivotally coupled to the mechanism, and the second end being pivotally coupled to an ottoman linkage, the rear ottoman link also being pivotally coupled to the second end of the ottoman lock link;

a spring activation link pivotally coupled to the ottoman lock link at a location spaced part-way between the first and second ends of the ottoman lock link, the spring activation link having first and second ends;

a spring extending between the lock bracket and the first end of the spring activation link; and a catch finger coupled to the rear ottoman link, the catch finger positioned on the rear ottoman link to engage the second end of the spring activation link;

wherein the spring activation link operates to extend the spring as the ottoman moves from an extended position to a closed position, thereby providing an assisting force in moving the mechanism to the closed position.

7. The mechanism of claim 6, further comprising a spring retaining link pivotally coupled to the lock bracket, a portion of said spring retaining link extending through said spring.

8. The mechanism of claim 7, wherein the spring retaining link has a spring retaining notch to capture the end of the spring opposite the first end of the spring activation link.

9. The mechanism of claim 8, wherein the catch finger is configured to capture a pin on the second end of the spring activation link as the mechanism moves from the closed to the extended position.

10. The mechanism of claim 9, further comprising a torsion spring coupled to the catch finger to bias the catch finger, to release the catch finger from the pin on the second end of the spring activation link when the mechanism moves to the closed position.

11. An assist linkage for a mechanism having at least a seat mounting plate and an ottoman extension linkage, the assist linkage providing an assisting force to aide in closing the ottoman extension linkage, as the ottoman extension linkage moves from an extended position back to a closed position, the assist linkage comprising:

a lock bracket rotatable with respect to the seat mounting plate;

an ottoman lock link having first and second ends, the first end being pivotally coupled to the lock bracket, the second end being pivotally coupled to the rear ottoman link;

a rear ottoman link having first and second ends, the first end being pivotally coupled to the seat mounting plate, and the second end being pivotally coupled to an ottoman linkage, the rear ottoman link also being pivotally coupled to the second end of the ottoman link, such that rotation of the rear ottoman link rotates the ottoman lock link;

a spring activation link pivotally coupled to the ottoman lock link at a location spaced part-way between the first and second ends of the ottoman lock link, the spring activation link having first and second ends;

a spring extending between the lock bracket and the first end of the spring activation link; and a catch finger coupled to the rear ottoman link, the catch finger positioned on the rear ottoman link to selectively capture the second end of the spring activation link as the mechanism moves from the closed to the extended position; and wherein the spring activation link is rotated as the ottoman linkage moves from the extended to the closed position, and extends the spring, thereby providing an assisting force in moving the ottoman linkage to the closed position.

12. The assist linkage of claim 11, further comprising a spring retaining link pivotally coupled to the lock bracket, a portion of said spring retaining link extending through said spring.

13. The assist linkage of claim 12, wherein the spring retaining link has a spring retaining notch to capture the end of the spring opposite the first end of the spring activation link.

14. The assist linkage of claim 13, wherein the catch finger is configured to capture a pin on the second end of the spring activation link as the mechanism moves from the closed to the extended position.

15. The assist mechanism of claim 14, further comprising a torsion spring coupled to the catch finger to bias the catch finger, to release the catch finger from the pin on the second end of the spring activation link when the mechanism moves to the closed position.

* * * * *